US010724732B2

(12) United States Patent
Schenkl et al.

(10) Patent No.: US 10,724,732 B2
(45) Date of Patent: Jul. 28, 2020

(54) VARIABLE COLOUR TEMPERATURE LIGHTING DEVICE FOR DOMESTIC ELECTRICAL APPLIANCES

(71) Applicant: emz-Hanauer GmbH & Co. KGaA, Nabburg (DE)

(72) Inventors: Johann Schenkl, Bodenwoehr (DE); Manfredi Signorino, Wackersdorf (DE); Martin Brabec, Nabburg (DE); Moritz Laubscher, Regensburg (DE)

( * ) Notice: Subject to any disclaimer, the term of this patent is extended or adjusted under 35 U.S.C. 154(b) by 0 days.

(21) Appl. No.: 16/036,981

(22) Filed: Jul. 17, 2018

(65) Prior Publication Data

US 2019/0137092 A1 May 9, 2019

(30) Foreign Application Priority Data

Jul. 17, 2017 (DE) ..... 10 2017 006 756

(51) Int. Cl.
*F21V 33/00* (2006.01)
*F24C 15/00* (2006.01)
(Continued)

(52) U.S. Cl.
CPC ..... *F21V 33/0044* (2013.01); *D06F 39/00* (2013.01); *F21V 23/04* (2013.01);
(Continued)

(58) Field of Classification Search
CPC .. F21V 33/0044; F21V 23/04; F21Y 2113/13; F24C 15/008; D06F 39/00; H05B 45/20
See application file for complete search history.

(56) References Cited

U.S. PATENT DOCUMENTS 6,292,901 B1 * 9/2001 Lys ..... A61N 5/0616 713/300
6,995,355 B2 2/2006 Rains, Jr. et al.
(Continued)

FOREIGN PATENT DOCUMENTS

CN 103930714 A 7/2014
DE 10338661 A1 3/2005
(Continued)

OTHER PUBLICATIONS

German Patent Office search report for counterpart application DE 10 2017 006 756.2; dated Apr. 4, 2018.
(Continued)

*Primary Examiner* — Anabel Ton
(74) *Attorney, Agent, or Firm* — Axel Wuesthoff; Sarita Pickett; Robert Deleault

(57) ABSTRACT

A lighting device for lighting an interior of a domestic electrical appliance is configured to be operated in different lighting modes which differ from one another by the spectral composition of the light of the lighting device delivered into the appliance interior. In some embodiments, the lighting device comprises two light-emitting diodes which differ from one another in terms of the spectral content of the light delivered thereby. The different lighting modes of the lighting device differ from one another by a different operating combination of the light-emitting diodes. By varying the duty cycle and the pulse frequency of a pulse-width-modulated control signal, a control assembly is able to transmit two different pieces of control information to the lighting module in order to control the two light-emitting diodes individually.

16 Claims, 3 Drawing Sheets

(51) Int. Cl.

| | |
|---|---|
| ***D06F 39/00*** | (2020.01) |
| ***H05B 45/20*** | (2020.01) |
| ***F21V 23/04*** | (2006.01) |
| *D06F 37/26* | (2006.01) |
| *D06F 33/00* | (2020.01) |
| *D06F 34/18* | (2020.01) |
| *D06F 34/28* | (2020.01) |
| *F21Y 113/13* | (2016.01) |
| *F21Y 115/10* | (2016.01) |
| *F21W 131/305* | (2006.01) |
| *F21W 131/307* | (2006.01) |

(52) U.S. Cl.

CPC ..... *F24C 15/008* (2013.01); *H05B 45/20* (2020.01); *D06F 33/00* (2013.01); *D06F 34/18* (2020.02); *D06F 34/28* (2020.02); *D06F 37/266* (2013.01); *D06F 2202/10* (2013.01); *D06F 2204/10* (2013.01); *D06F 2216/00* (2013.01); *D06F 2224/00* (2013.01); *F21W 2131/305* (2013.01); *F21W 2131/307* (2013.01); *F21Y 2113/13* (2016.08); *F21Y 2115/10* (2016.08)

(56) References Cited

U.S. PATENT DOCUMENTS

| | | | | |
|---|---|---|---|---|
| 7,252,402 | B2 | 8/2007 | Gotz et al. | |
| 8,334,643 | B2 * | 12/2012 | Giordano | F21K 9/00 313/113 |
| 9,551,466 | B2 | 1/2017 | Goldstein et al. | |
| 10,100,984 | B2 * | 10/2018 | Dubuc | F21V 7/0008 |
| 2003/0076281 | A1 * | 4/2003 | Morgan | F24C 7/004 345/44 |
| 2006/0201181 | A1 * | 9/2006 | Bauer | F21V 33/0044 62/264 |
| 2009/0080178 | A1 | 3/2009 | Wilsdorf | |
| 2010/0033949 | A1 * | 2/2010 | Hering | A47L 15/4251 362/91 |
| 2017/0047487 | A1 * | 2/2017 | Rossi | F21V 9/30 |
| 2017/0122568 | A1 | 5/2017 | Ivanovic et al. | |

FOREIGN PATENT DOCUMENTS

| | | | |
|---|---|---|---|
| DE | 202005012027 | U1 | 11/2006 |
| DE | 102005060359 | A1 | 6/2007 |
| DE | 102006034918 | A1 | 1/2008 |
| DE | 202007013346 | U1 | 1/2008 |
| DE | 102009027900 | A1 | 1/2011 |
| DE | 102012105690 | A1 | 1/2014 |
| DE | 1020012218002 | A1 | 4/2014 |
| DE | 102013210823 | B3 | 11/2014 |
| JP | 2007-535114 | A | 11/2007 |
| JP | 2008079819 | A | 4/2008 |
| KR | 1020070045406 | A | 5/2007 |
| WO | 03036176 | A1 | 5/2003 |
| WO | 2005/106408 | A2 | 11/2005 |
| WO | 2009040198 | A2 | 4/2009 |

OTHER PUBLICATIONS

German Patent Office office action for counterpart application DE 10 2017 006 756.2; dated Jul. 25, 2018.

KR Office Action in co-pending application, KR Appl. No. 10-2018-0082364. dated Jul. 21, 2019.

Chinese Office Action, Appl. No. 201810780365.9 dated Jul. 31, 2019.

German Office Action, Appl. No. 10 2017 012 206.7 dated Jul. 29, 2019.

* cited by examiner

VARIABLE COLOUR TEMPERATURE LIGHTING DEVICE FOR DOMESTIC ELECTRICAL APPLIANCES

BACKGROUND OF THE INVENTION

1. Field of the Invention

The present invention relates generally to a lighting device for lighting an interior of a domestic electrical appliance.

2. Description of the Prior Art

It is generally conventional to make it more comfortable for a user to load and unload the interior of a domestic electrical appliance with items which are to be kept cool or otherwise treated (e.g. cooked or washed) in the interior by lighting the interior. In an electric oven, the lighting of the interior additionally also has the purpose of allowing the user to observe the food that is cooking through a viewing pane provided in the oven door and thus visually check the progress of cooking. In conventional ovens, the viewing pane is often manufactured from such a material or has such a construction that radiation in the infra-red wavelength range is able to penetrate outwards through the viewing pane in the direction away from the cooking chamber only comparatively poorly. This is intended to minimize heat losses due to the escape of infra-red radiation. This filtering function has the result that not only radiation components that are invisible to the human eye but also radiation components in the visible red range are prevented by the viewing pane from passing outwards. If the user opens the oven door, on the other hand, this filtering function is eliminated, so that the colour impression of the illuminated interior can differ significantly for the user depending on whether the door is open or closed. Because of the filtering function of the viewing pane explained above, the user can perceive the interior light as warmer when the door is open, as a result of the increased passage of the red component outwards, than when the door is closed. Under the changed light conditions when the door is open, the progress of the cooking process may consequently appear different to the user when the door is open than when the door is closed, when he observes the food that is cooking through the viewing pane.

SUMMARY OF THE INVENTION

One object underlying the present invention can therefore be formulated as being that of providing, in a domestic oven with a viewing pane having an IR filtering function in the door, a way in which different colour impressions of the cooking chamber light when the oven door is open and closed can be reduced, or ideally even avoided.

In order to achieve that object inter alia, the present invention provides a lighting device for lighting an interior of a domestic electrical appliance, where the lighting device is configured to be operated in different lighting modes which differ from one another by the spectral composition of the light of the lighting device delivered into the appliance interior. By varying the spectral composition of the light, the subjective colour impression of an observer can be influenced. In some embodiments, the lighting device is configured to be operated in a plurality of lighting modes which can be adjusted in discrete steps. In other embodiments, the lighting mode of the lighting device can be continuously adjusted. In a domestic oven, for example, the solution according to the invention provides the possibility of setting a different spectral composition of the light of the lighting device delivered into the cooking chamber of the oven when the oven door is closed than when the door is open. In this manner, differences in the colour perception which can otherwise occur between an open door and a closed door as a result of the infra-red filtering function of a viewing pane set into the oven door can be compensated for at least in part. Thus, for example, a spectral composition of the light of the lighting device delivered into the cooking chamber can be set with a lower red component when the oven door is open than when the door is closed.

In some embodiments, the light of the lighting device delivered into the appliance interior is white light at least in some of the lighting modes, the different spectral composition of the light in the various lighting modes being accompanied by a different colour temperature of the white light.

In some embodiments, the lighting device comprises a plurality of light sources which are each configured to emit light of different spectral contents, the lighting modes differing from one another by a different operating combination of the light sources. The light sources can be, for example, light-emitting diodes (LEDs), but the present invention is not limited to this technology of illuminants. At least one of the light sources can be a white light source. For example, it is provided in some embodiments that the light sources comprise at least two white light sources which are configured to emit white light of different colour temperatures. In other embodiments, it can be provided that the light sources comprise at least one red light source or/and at least one blue light source or/and at least one yellow light source. For example, in some embodiments a first light source in the form of a blue or red light source is combined with a second light source in the form of a white light source.

In some embodiments, the operating combinations comprise at least two operating combinations which differ from one another by a different combination of radiation intensities of at least two of the light sources. Different combinations of radiation intensities can consist, for example, in changing the radiation intensity with which a first of the light sources is operated between a first operating combination and a second operating combination, while the radiation intensity with which a second of the light sources is operated is the same in the first and the second operating combinations. It is, however, possible that the radiation intensity of the second light source is also varied between the first operating combination and the second operating combination. The radiation intensity can be influenced by varying in terms of magnitude an electric variable with which the light source in question is controlled, for example a control voltage or a control current.

In some embodiments, the operating combinations comprise a first operating combination in which a specific one of the light sources is switched off, and at least a second operating combination in which the specific light source is switched on. By switching one light source off and on while another light source is operated with constant (or optionally varying) radiation intensity, it is likewise possible to modify the spectral composition of the light of the lighting device delivered into the appliance interior.

In order to obtain a mixture of the light of the light sources in the appliance interior (the mixing ratio being different in terms of spectral content for each lighting mode), the lighting device according to the invention in some embodiments comprises a reflective or/and transmissive diffusion structure for mixing the light of each of the light sources. For example, the lighting device can have a reflecting surface in the beam path between the light sources and the appliance interior, from which reflecting surface light incident thereon is deflected in the direction towards a transmissive light outlet pane, through which the light enters the appliance interior. In order to achieve a reflective diffusion structure, the reflecting surface in such an embodiment of the lighting device can be configured at least in part-regions with sufficiently pronounced surface roughness, so that light which is incident on the part-regions in question is not reflected directionally but is scattered diffusely. Alternatively or in addition, the light outlet pane can effect diffuse light scattering, for example in that the light outlet pane is milky or/and diffusion zones are formed on a pane surface or within the pane material of the light outlet pane by etching, laser engraving or another processing technique.

In some embodiments, the lighting device comprises a transmissive light outlet structure which is common to each of the plurality of light sources and from which the light of the lighting device emerges into the appliance interior. The mentioned light outlet pane can form such a common transmissive light outlet structure.

In some embodiments, the lighting device comprises an evaluation unit which is adapted to determine from a pulse-width-modulated control signal a first control variable which is representative of the duty cycle of the control signal and to control a first light source (or a group of first light sources) from the plurality of light sources in dependence on the first control variable. It is thus possible via the duty cycle of the control signal (ratio of the pulse width to the period) to provide a piece of control information which allows the evaluation unit to control operation of at least one of the light sources. By continuous adjustment of the duty cycle of the control signal, it is possible in particular to continuously vary a control variable, for example an electric control voltage, derived from the duty cycle.

A piece of control information can also lie in the period of a periodic but frequency-adjustable control signal. In some embodiments, this is used to transmit two pieces of control information for two different light sources or two groups of different light sources via a pulse-width-modulated control signal. A first piece of control information lies in the duty cycle of the control signal, while a second piece of control information lies in the period of the control signal. Accordingly, in these embodiments the evaluation unit is adapted to determine from the pulse-width-modulated control signal a second control variable which is representative of the period of the control signal and to control a second light source (or a group of second light sources) from the plurality of light sources in dependence on the second control variable.

The present invention relates not only to the lighting device as such but also to a domestic electrical appliance equipped with such a lighting device, in which the lighting device serves for lighting the appliance interior, which in turn can be closed by a door. The domestic appliance is, for example, an oven, a refrigerator or a washing machine.

Where the domestic appliance is in the form of an oven in which the appliance interior forms a cooking chamber, the oven comprises a control device which is configured, in dependence on the detection of a closed state of the door, to effect operation of the lighting device in a first lighting mode and, in dependence on the detection of an open state of the door, to effect operation of the lighting device in a second lighting mode. In the first lighting mode, the light delivered by the lighting device into the cooking chamber has a higher red component than in the second lighting mode. As explained at the beginning, by adding a higher red component to the light delivered overall into the cooking chamber when the oven door is closed, it is possible to compensate at least in part for an infra-red filtering effect caused by a viewing pane in the oven door, so that a user perceives less considerable colour temperature differences between the open door and the closed door.

When the domestic appliance is in the form of a refrigerator in which the appliance interior forms a cooling chamber, on the other hand, the refrigerator can comprise a control device which is configured, in dependence on the detection of a state of relatively slight loading of the cooling chamber, to effect operation of the lighting device in a first lighting mode and, in dependence on the detection of a state of relatively great loading of the cooling chamber, to effect operation of the lighting device in a second lighting mode, wherein in the first lighting mode the light delivered by the lighting device into the cooling chamber has a higher blue component than in the second lighting mode. For the purposes of presentation in commercial premises, a cooler colour temperature of the interior lighting of the refrigerator is occasionally desired, since the appliance may then appear more aesthetically pleasing to a potential purchaser. For domestic use, on the other hand, an inducement to purchase is not the important factor; here, it has been shown that a warmer colour temperature of the refrigerator lighting is often perceived as more pleasing by the user. In showrooms of a sales outlet, the refrigerator is typically presented to the public empty; in domestic operation, on the other hand, it is generally more or less greatly loaded. By detecting the loading state of the cooling chamber, for example by means of a camera and subsequent image evaluation, the control device of the refrigerator is therefore able to distinguish whether the refrigerator is in domestic use or not. Depending on the result of this detection, the control device can adjust a higher or lower blue component in the light delivered by the lighting device into the cooling chamber and thus a different colour temperature of that light.

Where the domestic appliance is in the form of a washing machine having a rotating washing vessel which forms the appliance interior, the washing machine can comprise a control device which is configured to effect operation of the lighting device in different lighting modes in dependence on the result of a colour analysis of laundry introduced into the washing vessel. If predominantly white laundry has been introduced into the washing vessel, a higher blue component (cooler colour temperature) of the light of the lighting device delivered into the washing vessel may be advantageous, for example. If, on the other hand, predominantly coloured laundry is in the washing vessel, a warmer colour temperature of the light may be advantageous. For the colour analysis, the washing machine can comprise a camera with suitable image evaluation software.

According to a further embodiment, the domestic appliance can comprise a control device which is configured to effect operation of the lighting device in a different lighting mode at different times of day. This is based on the finding that the human eye can have a different colour perception at different times of day, for example depending on the brightness of the ambient light or/and the spectral composition of the ambient light, whereby the colour perception can vary inter alia depending on whether the ambient light is natural light or is from an artificial light source. Tiredness of the eyes can also lead to a changed colour perception. Thus, the human eye is typically rested in the morning after getting up and can therefore deliver a different colour perception than later in the course of the day, when the eye is possibly already tired. The domestic appliance can comprise suitable means for detecting, for example, the time of day or/and the brightness of the ambient light or/and the spectral composition of the ambient light and can set a suitable lighting mode of the lighting device in dependence on the information so acquired.

The invention is explained in greater detail below with reference to the accompanying drawings.

DETAILED DESCRIPTION OF THE INVENTION

Figure 1:
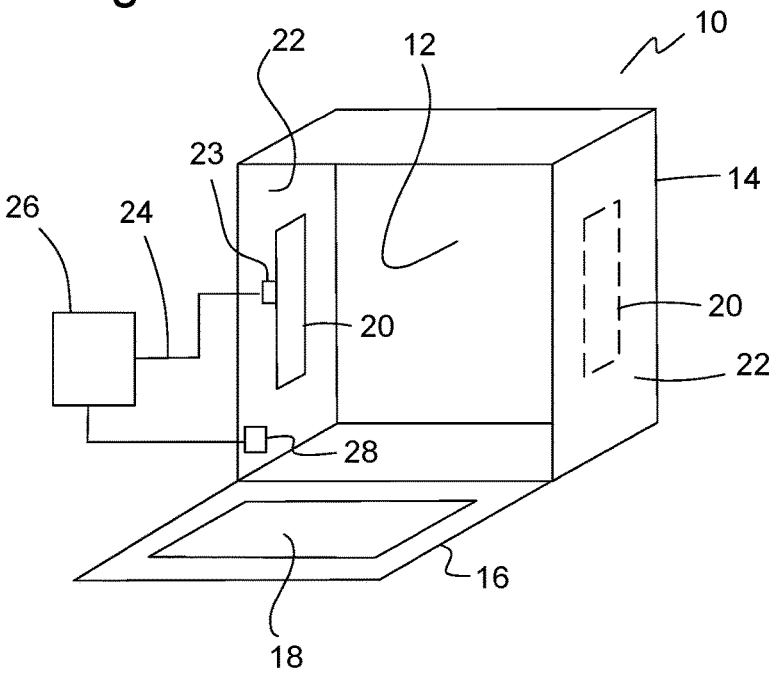
FIG. 1 shows, schematically, components of a domestic oven according to an exemplary embodiment.

Reference will first be made to FIG. 1. The domestic oven shown therein is generally designated 10. It comprises an oven muffle 14 forming a cooking chamber 12, and a pivotable oven door 16 for closing the cooking chamber 12. A viewing window 18 is formed in the oven door 16, the window pane of which viewing window is transparent and has a filtering function for infra-red radiation in order to reduce heat losses during cooking operation of the oven 10, which filtering function prevents such radiation from escaping from the cooking chamber 12 through the viewing window 18. A lighting module 20 in the form of a panel light is fitted into at least one of the muffle walls of the oven muffle 14 that delimit the cooking chamber 12. In the example shown, at least one such lighting module 20 is fitted into each of two mutually opposite side walls 22 of the oven muffle 14. The lighting module 20 is a prefabricated component which can be inserted as such into a suitable wall opening in the relevant muffle wall of the oven muffle 14 and has a module housing (not shown in detail in the drawings) having a receiving socket for a connecting plug 23 of a connection cable 24 which serves for supplying power to and controlling the lighting module 20. The connection cable 24 connects the lighting module 20 to an electrical control assembly 26 of the oven 10. As well as controlling the lighting module 20, the control assembly 26 is also responsible for controlling any other operating functions of the oven 10.

A door sensor 28 serves for detecting the position of the oven door 16. On the basis of the detection signal of the door sensor 28, the control assembly 26 is able to determine whether the oven door 16 is closed or whether it is (at least partly) open. Depending on whether the control assembly 26 detects a closed state or an open state of the oven door 16, it controls the lighting module 20 differently in lighting operation. Specifically, the control assembly 26 controls the lighting module 20 in lighting operation when the oven door 16 is closed in such a manner that the lighting module 20 works in a first lighting mode in which the light delivered by the lighting module 20 into the cooking chamber 12 has a relatively greater red component overall than in a second lighting mode, which the control assembly 26 triggers for the lighting module 20 when the control assembly 26 detects an open position of the oven door 16 during lighting operation. The increased red component in the first lighting mode compared with the second lighting mode at least partially offsets the filtering action of the viewing pane of the viewing window 18 for infra-red radiation (this filtering action typically extends into the visible red range), so that the user has an at least similar or even identical colour impression when he looks into the cooking chamber 12 once when the oven door 16 is open and another time when he looks into the cooking chamber 12 through the viewing window 18 when the oven door 16 is closed.

In order to achieve the different lighting modes, the lighting module 20 can comprise a plurality of individually controllable light-emitting diodes each with a different spectral content of the light emitted by the light-emitting diode in question. In this respect, reference will now additionally be made to FIG. 2, which shows, in a schematic representation, an example of a configuration of the lighting module 20. In this exemplary embodiment, the lighting module 20 has a circuit board 30 on which there is mounted at least one group of light-emitting diodes which are advantageously arranged closely adjacent to one another. In the example shown, the group comprises two light-emitting diodes $\mathbf{32}_1$, $\mathbf{32}_2$ in total; it will be appreciated that the group may also contain more than two light-emitting diodes, for example three. Each of the light-emitting diodes $\mathbf{32}_1$, $\mathbf{32}_2$ of the group is designed for a different spectral composition of the emitted light of the light-emitting diode in question. For example, one of the light-emitting diodes $\mathbf{32}_1$, $\mathbf{32}_2$ is a white-light LED with a lower colour temperature, while the other of the light-emitting diodes $\mathbf{32}_1$, $\mathbf{32}_2$ is a white-light LED with a higher colour temperature. For example, a colour temperature in a range between approximately 2000 and 3000 K can be chosen for the cooler white-light LED, and a colour temperature in a range between approximately 5000 and 6000 K can be chosen for the warmer white-light LED. Other colour temperature values are of course conceivable. According to another example, one of the light-emitting diodes $\mathbf{32}_1$, $\mathbf{32}_2$ can be a white-light LED, in particular a white-light LED with a comparatively low colour temperature, while the other of the light-emitting diodes $\mathbf{32}_1$, $\mathbf{32}_2$ is a red-light LED. Depending on the dimensions of the lighting module 20, a plurality of light-emitting diode groups can be mounted on the circuit board 30 if required, as is shown by way of example in FIG. 3. In the case of a plurality of light-emitting diode groups, each group preferably contains the same combination of light-emitting diodes. In the example shown, each of the light-emitting diode groups accordingly consists of a light-emitting diode $\mathbf{32}_1$ and a light-emitting diode $\mathbf{32}_2$.

Figure 2:
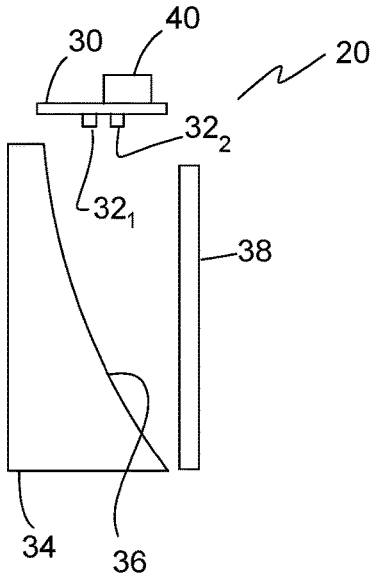
FIG. 2 shows, schematically, components of an exemplary lighting device for the interior lighting of a domestic electrical appliance.
Figure 3:
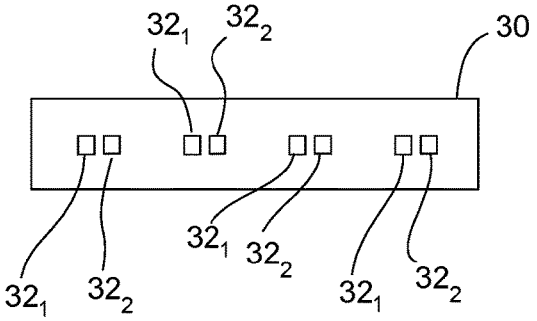
FIG. 3 shows, schematically, a circuit board having a plurality of light source groups.

In the exemplary embodiment according to FIG. 2, the lighting module 20 additionally comprises a reflecting body 34 which forms a reflecting surface 36, and a light outlet pane 38 made of light-permeable material which in the fitted situation according to FIG. 1 is located approximately flush with the relevant muffle wall of the oven muffle 14 into which the lighting module 20 is fitted. At least a large part of the light emitted by the light-emitting diodes $\mathbf{32}_1$, $\mathbf{32}_2$ first strikes the reflecting surface 36, which deflects the light in the direction towards the light outlet pane 38. For the purpose of mixing the light of the two light-emitting diodes $\mathbf{32}_1$, $\mathbf{32}_2$ as homogeneously as possible, the light outlet pane 38 is in the form of a diffuser pane. Alternatively or in addition, the reflecting surface 36 can have a diffusely scattering effect, for example by the provision of sufficiently great surface roughness at least in part-regions of the reflecting surface 36. The aim is that the light of the light-emitting diodes $\mathbf{32}_1$, $\mathbf{32}_2$ is sufficiently mixed when it leaves the light outlet pane 38, so that the user does not perceive the light of an individual light-emitting diode but perceives only the total light resulting from the mixing of the light of both light-emitting diodes $\mathbf{32}_1$, $\mathbf{32}_2$.

Figure 4:
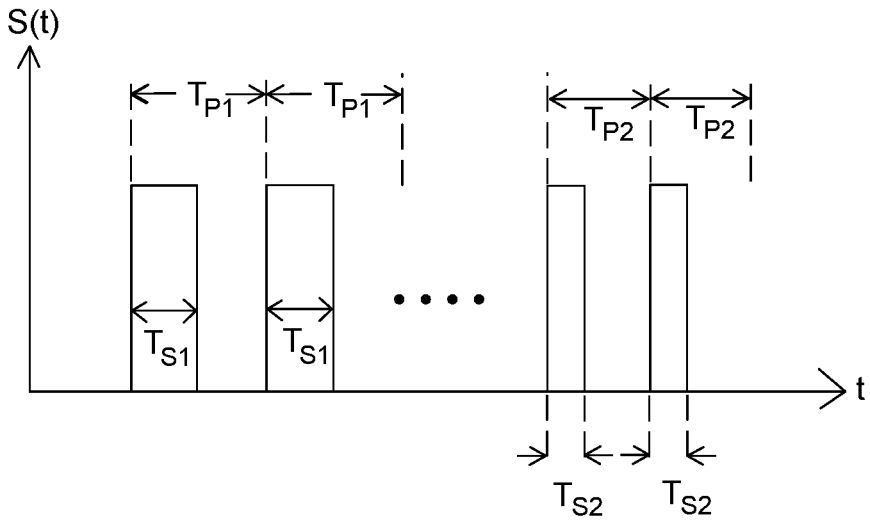
FIG. 4 shows an example of the profile over time of a pulse-width-modulated control signal as the carrier of two pieces of control information.

It is conceivable in principle that the control assembly 26 delivers separate control signals for the light-emitting diodes $\mathbf{32}_1$, $\mathbf{32}_2$ of each light-emitting diode group to the lighting module 20 via the connection cable 24. In an embodiment which will be described in greater detail below, on the other hand, instead of generating separate control signals the control assembly 26 generates a common control signal which carries two different pieces of control information, namely one piece of control information for the light-emitting diode $\mathbf{32}_1$ and one piece of control information for the light-emitting diode $\mathbf{32}_2$. In the specific example, this common control signal is a pulse-width-modulated control signal with a variable duty cycle and a variable period. FIG. 4 shows an example of the profile over time of such a pulse-width-modulated control signal (denoted s(t)). It will be seen that, during a first phase, the control signal s(t) (the variable t stands for time) has pulses with a duration of $T_{s1}$ which follow one another with a frequency of $1/T_{P1}$ ($T_{P1}$ is the period of the pulses of the control signal s(t)). The duty cycle of the control signal s(t) is given as the ratio of the pulse width to the period (i.e. $T_{s1}/T_{P1}$) and in the mentioned first phase is approximately 50%, as is readily apparent from FIG. 4 by a simple dimensional comparison. In a later second phase of the control signal s(t), the period has shortened to a value $T_{P2}$, that is to say the pulse frequency has increased to $1/T_{P2}$. The pulse width has reduced in this second phase to a value $T_{s2}$, which in the graphical representation of FIG. 4 corresponds to approximately one third of the period $T_{P2}$. The duty cycle $T_{s2}/T_{P2}$ is thus approximately 33% in the second phase.

The lighting module 20 has a suitable evaluation unit which is shown at 40 in FIG. 2, can be mounted on the circuit board 30 together with the light-emitting diode groups and evaluates the received control signal s(t) in respect of the duty cycle and the pulse frequency (period). On the basis of the determined duty cycle, the evaluation unit 40 generates a first control variable with which it controls one of the two light-emitting diodes $\mathbf{32}_1$, $\mathbf{32}_2$ of each light-emitting diode group. On the basis of the determined pulse frequency (period), the evaluation unit 40 generates a second control variable with which it controls the other of the light-emitting diodes $\mathbf{32}_1$, $\mathbf{32}_2$. The first and second control variables are, for example, each a control current which is applied to the light-emitting diode $\mathbf{32}_1$, $\mathbf{32}_2$ in question and specifies the radiation intensity of the light-emitting diode in question. The control assembly 26 and the evaluation unit 40 can cooperate in such a manner that both light-emitting diodes $\mathbf{32}_1$, $\mathbf{32}_2$ of each light-emitting diode group are operated in such a manner that they are continuously adjustable via the duty cycle, or pulse frequency, of the control signal s(t) or at least one of the light-emitting diodes $\mathbf{32}_1$, $\mathbf{32}_2$ is operated in such a manner that it is adjustable in discrete steps. In a simple case, the discrete steps can mean on/off operation of the light-emitting diode in question, that is to say the light-emitting diode is either switched off or it is operated with a constant radiation intensity. Alternatively, the discrete steps can comprise a plurality of on-states of the light-emitting diode in question of different radiation intensity.

By means of the described technique of controlling the light-emitting diodes $\mathbf{32}_1$, $\mathbf{32}_2$ via the control signal s(t), different spectral compositions of the mixed light delivered overall by the lighting module 20 can be achieved. Where the lighting module 20 is used in the oven 10 of FIG. 1, for example, a configuration is possible in which one of the light-emitting diodes $\mathbf{32}_1$, $\mathbf{32}_2$ is a white-light LED which is always operated with a constant radiation intensity, and the other light-emitting diode is a red-light LED which is switched on when the oven door 16 is closed and off when the oven door 16 is open. In another embodiment, both light-emitting diodes $\mathbf{32}_1$, $\mathbf{32}_2$ are in the form of white-light LEDs, but with different colour temperatures, whereby when the oven door 16 is closed the warmer of the two white-light LEDs is operated with a relatively greater radiation intensity in comparison with the cooler of the white-light LEDs than when the oven door 16 is open.

For the purposes of a brief explanation of two other possible fields of use of the lighting module 20, reference will now be made to FIGS. 5 and 6. In those figures, components which are the same or have the same effect are provided with the same reference numerals but with the addition of a lowercase letter. Unless otherwise apparent below, reference is made to the above explanations relating to FIGS. 1 to 4 for the explanation of such components.

Figure 5:
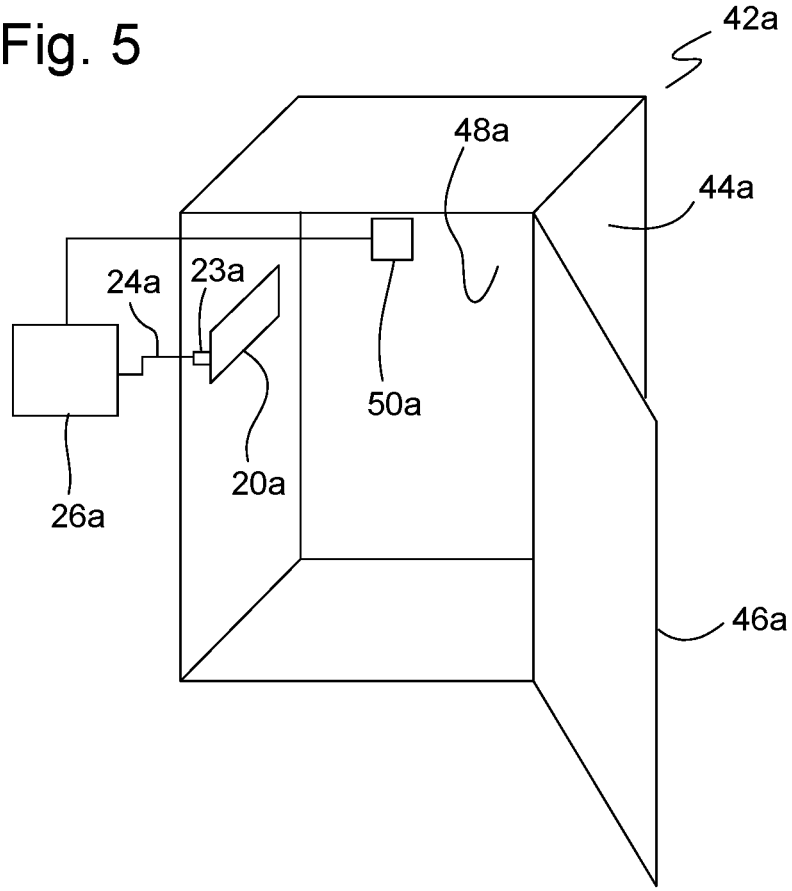
FIG. 5 shows, schematically, components of a domestic refrigerator according to an exemplary embodiment.

FIG. 5 shows a domestic refrigerator designated generally **42*a* having a cabinet body 44*a* and a cabinet door 46*a*. The interior of the cabinet body 44*a* forms a cooling chamber 48*a* which serves for keeping foods cool. For reasons of clarity, shelves, drawers and other storage aids which are conventionally to be found in a refrigerator are not shown in FIG. 5**.

A lighting module **20*a* is fitted into one of the body walls of the cabinet body 44*a* delimiting the cooling chamber 48*a* in order to light the cooling chamber 48*a* when the refrigerator door 46*a* is open. Depending on the loading state of the cooling chamber 48*a*, the lighting module 20*a* is adjusted into different lighting modes by a control assembly 26*a*. Specifically, if an empty or slightly filled state of the cooling chamber 48*a* is detected, the control assembly 26*a* controls the lighting module 20*a* in such a manner that the light delivered by the lighting module 20*a* into the cooling chamber 48*a* has a greater blue component than in a case where greater loading of the cooling chamber 48*a* with food is detected. For determining the loading state, the refrigerator 42*a* comprises a camera 50*a*, shown schematically, which provides its camera data to the control assembly 46*a*, which generates information about the loading state of the cooling chamber 48*a* from the camera images by means of suitable image evaluation software. For varying the blue component of the light delivered by the lighting module 20*a***, one of the light-emitting diodes $\mathbf{32}_1$, $\mathbf{32}_2$ of each light-emitting diode group can be a blue-light LED, for example, and the other light-emitting diode can be formed by a white-light LED. Depending on the detected loading state, the blue-light LED can be switched on or off, for example, while the white-light LED is operated with constant radiation intensity. Alternatively, both light-emitting diodes $\mathbf{32}_1$, $\mathbf{32}_2$ can be formed by white-light LEDs each having a different colour temperature, the ratio of the radiation intensities of the two light-emitting diodes being varied in dependence on the detected loading state.

Figure 6:
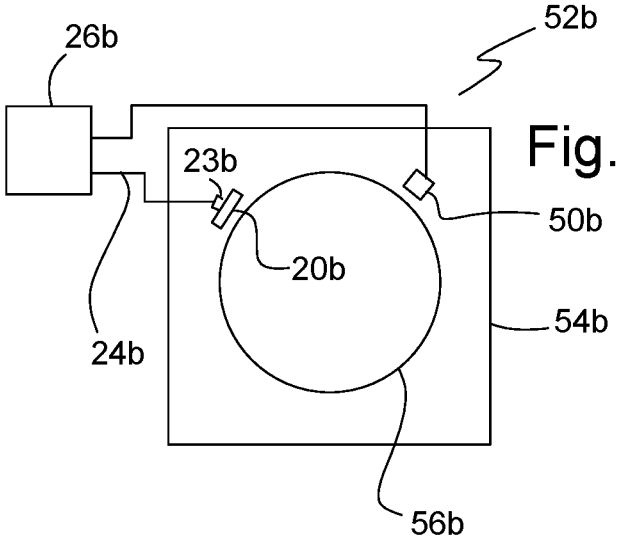
FIG. 6 shows, schematically, components of a domestic washing machine according to an exemplary embodiment.

FIG. 6 shows a domestic washing machine **52*b* which comprises a washing vessel 56*b* rotatably mounted in a machine frame 54***b*. The washing vessel 56*b* is accessible through an access opening (not shown in detail) in the machine frame 54*b*. The access opening can be closed in the conventional manner by a door (likewise not shown in detail). A lighting module 20*b* serves for lighting the interior of the washing vessel 56*b* into which the laundry to be washed is introduced. The lighting module 20*b* can be inserted, for example, into a door seal (not shown in detail) which extends around the access opening and seals the mentioned door relative to the machine frame 54*b*. A camera 50*b* serves for taking coloured images of the interior of the washing vessel 56*b*. The coloured images provided by the camera 50*b* are evaluated by a control assembly 26*b* for the purpose of a colour analysis of laundry introduced into the washing vessel 56*b*. If the washing vessel 56*b* contains predominantly white laundry, the control assembly 26*b* controls the lighting module 20*b* into a lighting mode in which the light delivered by the lighting module 20*b* into the vessel interior has a greater blue component than in another lighting mode into which the lighting module 20*b* is set by the control assembly 26*b* when the presence of coloured laundry in the washing vessel 56*b* is detected.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A lighting device for lighting an interior of a domestic electrical appliance, the lighting device comprising a plurality of light sources and an evaluation unit, wherein the plurality of light sources are configured to emit light of different spectral contents, wherein the lighting device is configured to be operated in different operating modes which differ from one another by a different operating combination of the light sources so as to create a respective different spectral composition of the light of the lighting device delivered into the appliance interior, wherein the evaluation unit is adapted to determine from a pulse-width-modulated control signal a first control variable and a second control variable, the first control variable being representative of the duty cycle of the control signal and the second control variable being representative of the period of the control signal, wherein the evaluation unit is further adapted to control a first light source from the plurality of light sources in dependence on the first control variable and to control a second light source from the plurality of light sources in dependence on the second control variable.

2. The lighting device according to claim 1, wherein the lighting modes comprise at least two lighting modes in which the light of the lighting device delivered into the appliance interior is white light of different colour temperatures.

3. The lighting device of claim 1, wherein the plurality of light sources are LEDs.

4. The lighting device according to claim 1, wherein the light sources comprise at least two white light sources which are configured to emit white light of different colour temperatures.

5. The lighting device according to claim 1, wherein the light sources comprise at least one light source selected from the group consisting of a red light source, a blue light source, and a yellow light source.

6. The lighting device according to claim 1, wherein the operating combinations comprise at least two operating combinations which differ from one another by a different combination of radiation intensities of at least two of the light sources.

7. The lighting device according to claim 1, wherein the operating combinations comprise a first operating combination in which a specific one of the light sources is switched off, and at least a second operating combination in which the specific light source is switched on.

8. The lighting device according to claim 1, comprising a reflective or/and transmissive diffusion structure for mixing the light of each of the light sources.

9. The lighting device according to claim 1, wherein the lighting device further comprises a transmissive light outlet structure which is common to each of the plurality of light sources and from which the light of the lighting device emerges into the appliance interior.

10. A domestic electrical appliance comprising:

an appliance interior which can be closed by a door, and a lighting device for lighting the appliance interior, wherein the lighting device is configured to be operated in different operating modes which differ from one another by the spectral composition of the light of the lighting device delivered into the appliance interior;

wherein the domestic electrical appliance is selected from a group consisting of a fridge, an oven, and a washing machine;

wherein when the domestic electrical appliance selected is the oven, the appliance interior forms a cooking chamber wherein the oven comprises a control device which is configured, in dependence on the detection of a closed state of the door, to effect operation of the lighting device in a first lighting mode and, in dependence on the detection of an open state of the door, to effect operation of the lighting device in a second lighting mode, wherein in the first lighting mode the light delivered by the lighting device into the cooking chamber has a higher red component than in the second lighting mode;

wherein when the domestic electrical appliance is the refrigerator, the appliance interior forms a cooling chamber, wherein the refrigerator comprises a control device which is configured, in dependence on the detection of a state of relatively slight loading of the cooling chamber, to effect operation of the lighting device in a first lighting mode and, in dependence on the detection of a state of relatively great loading of the cooling chamber, to effect operation of the lighting device in a second lighting mode, wherein in the first lighting mode the light delivered by the lighting device into the cooling chamber has a higher blue component than in the second lighting mode; and wherein when the domestic electrical appliance is the washing machine, the appliance interior is formed by a rotating washing vessel, wherein the washing machine comprises a control device which is configured to effect operation of the lighting device in different lighting modes depending on the result of a colour analysis of laundry introduced into the washing vessel.

11. A lighting device for lighting an interior of a domestic electrical appliance, wherein the lighting device is configured to be operated in different operating modes which differ from one another by the spectral composition of the light of the lighting device delivered into the appliance interior, wherein the lighting device comprises a plurality of LEDs configured to emit light of different spectral contents, wherein the lighting modes differ from one another by a different operating combination of the light sources, wherein the lighting device comprises a circuit board having mounted thereon a plurality of groups of individually controllable light-emitting diodes, each light-emitting diode of each group having a spectral composition of emitted light which is different from the spectral composition of emitted light of every other light-emitting diode of the group, wherein each group of the plurality of groups has the same combination of spectrally different light-emitting diodes.

12. The lighting device according to claim 11, wherein the plurality of groups are arranged in a straight row.

13. The lighting device according to claim 9, wherein the transmissive light outlet structure is in the form of a pane.

14. The lighting device according to claim 9, further comprising a reflecting body which forms a reflecting surface, wherein at least part of the light emitted by the plurality of light sources first strikes the reflecting surface, which deflects the light in the direction towards the transmissive light outlet structure, wherein the reflecting surface provides at least in a part-region thereof a diffusely scattering effect.

15. The domestic electrical appliance according to claim 10, wherein the lighting device comprises a plurality of light sources and an evaluation unit which is adapted to:

determine from a pulse-width-modulated control signal a first control variable which is representative of the duty cycle of the control signal;

determine from the pulse-width-modulated control signal a second control variable which is representative of the period of the control signal;

control a first light source of the plurality of light sources based on the first control variable; and control a second light source of the plurality of light sources based on the second control variable.

16. The lighting device according to claim 1, wherein at least one of the light sources is a white light source.

* * * * *